United States Patent [19]

Junker

[11] Patent Number: 4,709,508

[45] Date of Patent: Dec. 1, 1987

[54] METHOD AND APPARATUS FOR HIGH SPEED PROFILE GRINDING OF ROTATION SYMMETRICAL WORKPIECES

[76] Inventor: Erwin Junker, Talstrasse 78, 7611 Nordrach, Fed. Rep. of Germany

[21] Appl. No.: 906,558

[22] Filed: Sep. 8, 1986

Related U.S. Application Data

[63] Continuation of Ser. No. 705,475, Feb. 26, 1985, abandoned.

[30] Foreign Application Priority Data

Mar. 15, 1984 [DE] Fed. Rep. of Germany ..... 3409575
Sep. 26, 1984 [DE] Fed. Rep. of Germany ..... 3435313

[51] Int. Cl.[4] ..... B24B 5/00
[52] U.S. Cl. ..... 51/105 R; 51/50 R; 51/289 R
[58] Field of Search ..... 51/105 R, 50 R, 289 R, 51/95 WH

[56] References Cited

U.S. PATENT DOCUMENTS 1,394,704 10/1921 Barnhart .
1,968,550 7/1934 Barnes .
2,151,204 3/1939 Hartman ..... 51/98 SP X
3,881,887 5/1975 McMaster ..... 51/105 R X

FOREIGN PATENT DOCUMENTS 221244 9/1908 Fed. Rep. of Germany .
852502 8/1981 U.S.S.R. .

*Primary Examiner*—Frederick R. Schmidt
*Assistant Examiner*—Maurina Rachuba
*Attorney, Agent, or Firm*—Jordan and Hamburg

[57] ABSTRACT

In a method and an apparatus for high speed profile grinding of rotatably clamped rotation symmetrical workpieces, a grinding disk of an essentially flat surface line is being guided against the surface of the workpiece so that during the grinding process, the grinding disk touches the circumference of the workpiece in the region of the finished diameter only at a point which lies perpendicular to the longitudinal axis of the workpiece, whereby the surface line of the grinding disk forms a clearance angle with the circumferential line of the ground surface of the workpiece.

19 Claims, 10 Drawing Figures

METHOD AND APPARATUS FOR HIGH SPEED PROFILE GRINDING OF ROTATION SYMMETRICAL WORKPIECES

This is a continuation of application Ser. No. 705,475, filed Feb. 26, 1985 and now abandoned.

BACKGROUND OF THE INVENTION AND PRIOR ART STATEMENT

The invention relates to a method and an apparatus for high speed profile grinding of workpieces to be made perfectly rotation symmetrical (hereinafter "rotation symmetrical workpieces") which are clamped in a grinding machine for rotation around their longitudinal axes, wherein a grinding disk is advanced along the rotational axis of the workpiece and is radially adjusted according to the circumferential profile to be ground.

Up to now, in the process of profile grinding of revolving bodies, grinding disks having contours corresponding to the profiles to be ground are used. The grinding disks which are as wide as the profiles have the disadvantage of grinding workpieces under so-called "line contact" and accordingly high radial forces are required. As a result, cooling medium does not become optimally effective. In order to keep the heating of workpieces within limits, and generally also because of great mass of such a grinding disk, work proceeds at relatively low cutting speeds. This results in a relatively long working duration, which accordingly increases workpiece costs.

The DDR-PS No. 29 342 describes a polishing and grinding apparatus for circular symmetrical and asymmetrical thin-walled workpieces, wherein its moving components approximately correspond to those of grinding and polishing by hand, i.e., the workpiece continuously performs a pendulum-like swivelling motion by changing the advancing direction of the polishing apparatus. Although this publication does indicate an oblique position of the polishing and grinding disk with respect to the axis of the workpiece, this oblique position obviously means only that the workpiece can be polished exactly as intensively as by hand. This publication does not give any indication of how to create a clearance angle between the grinding disk grinding frontally and the workpiece, nor concerning the successive even wear of the grinding disk, which would not require constant adjustment.

SUMMARY OF THE INVENTION

The invention is based on the object of solving the technical problem as mentioned above and provides new method and apparatus for high speed circular or rotary grinding of rotation symmetrical workpieces which are clamped for rotation around their longitudinal axes, wherein each workpiece can be gently ground in the shortest possible time, as well as, the grinding disk can wear evenly successively along its circumference.

The problem of a method of the above prior art is solved, wherein the grinding disk grinding at a front surface, is guided towards a surface of the workpiece to be worked on, so that during the grinding process, the grinding disk touches the circumference of the workpiece only at a point which lies perpendicular to the longitudinal axis of the workpiece. The outer surface line of the grinding disk and the ground surface of the workpiece form a clearance angle, so that the finished ground surface is no longer engaged with the grinding disk.

The grinding machine for the execution of this method includes a rotation symmetrical workpiece rotatably clamped in a support at its two ends, and a grinding disk supported and driven by a grinding spindle, so that the grinding disk can be advanced along the rotational axis of the workpiece and can be radially adjusted according to the desired workpiece profile to be ground. The grinding disk has an essentially flat surface line and the grinding disk is arranged obliquely with respect to the workpiece.

This arrangement is expediently made wherein the surface of the grinding disk is cylindrical and the axis of the grinding disk forms an angle greater than 0 with respect to the longitudinal axis of the workpiece.

Advantageously, the axis of the grinding disk of a conical surface and the axis of the workpiece are arranged skewed to each other. It is also possible to make the arrangement so that the axis of the grinding spindle is horizontally and vertically swivelled and regulated with respect to the longitudinal axis of the workpiece. The expression "essentially flat surface" is meant to include surfaces either extending in a straight line or curving at a large curvature.

The essential advantage of the invention is that, with a reduction of the tool costs, it allows a considerably shortened grinding time at very low heat development. Disregarding the fact that heat accumulation in the workpiece is avoided, because of the utilization of a flat grinding disk it is possible to effect cooling in a much more concentrated manner than before. Further, the workpiece is not exposed to any extreme radial grinding pressures, because the individual active surface of the grinding disk which is engaged with the workpiece is relatively small, and, furthermore, a considerable portion of the grinding pressure is transmitted in the direction of the axis. This allows the machine to work at a relatively high cutting speed, because, in contrast to a conventional grinding, the force acting perpendicular to the axis becomes a fraction and this force acts only at a point of the circumference of the workpiece which lies perpendicular to the longitudinal axis of the workpiece. A further advantage is that the grinding disk wears evenly along one side in the form of a thin layer. It is therefore possible to mathematically determine when a layer of the circumference of the grinding disk has worn off, so that it can subsequently be readjusted. If the grinding disk is covered with a borazon coating, the service life is considerably increased.

Because of the oblique or skewed arrangement of the grinding disk with respect to the workpiece to be worked on, a clearance angle is formed between the surface line of the grinding disk and the circumferential line of the workpiece, which causes the grinding disk to act only upon the intended point of the workpiece, whereas it leaves room so that during the further grinding process, the grinding disk cannot again grind the finished profile. Whereas according to the invention, the grinding disk having an oblique frontal surface abrades the workpiece according to the desired depth, the final diameter of the workpiece being, however, ground by the grinding disk only at a point contact, according to "Fertigungstechnik und Betrieb" No. 23, bulletin 3, 1973, pages 166–171, the grinding configuration is arranged such that the axis of the grinding disk and the axis of the tool lie parallel in a plane and the grinding disk abrades the workpieces with two surface lines.

These and other advantages and objects of the present invention will become evident from the description which follows.

DETAILED DESCRIPTION OF THE PREFERRED EMBODIMENTS

Figure 2:
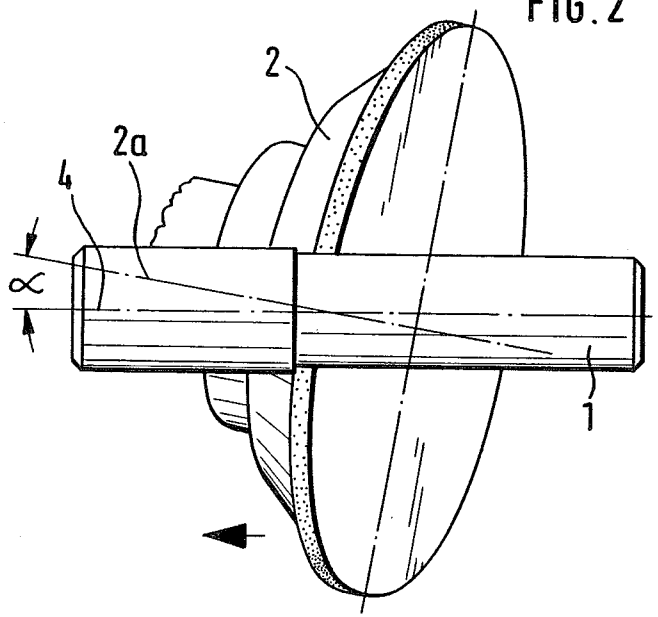
FIG. 2 is a front view of the arrangement of FIG. 1, whereby the axis of the grinding disk is vertically inclined towards the longitudinal axis of the workpiece.
Figure 1:
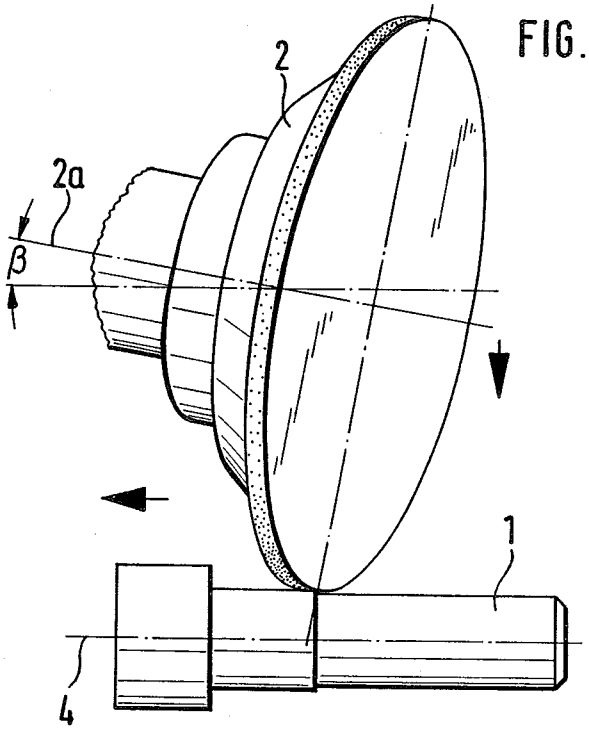
FIG. 1 is a schematic top plan view of the arrangement of a grinding body in relation to the workpiece, whereby the rotational axis of the grinding body is inclined towards the longitudinal axis of the workpiece.

In FIG. 1 is shown a rotation symmetrical rotary body, i.e., a workpiece 1, which is ground by a grinding body in the form of a narrow grinding disk 2. The rotational axis 2*a* of this grinding disk 2 is horizontally inclined at an angle towards the longitudinal axis 4 of the workpiece. In FIG. 2 is seen that the rotational axis 2*a* of the grinding disk is formed to further incline towards the axis 4 of the workpiece at a crossing angle $\beta$. The inclination of the grinding disk to the workpiece during grinding will be more clearly explained below with reference to FIGS. 3 and 4.

Figure 4:
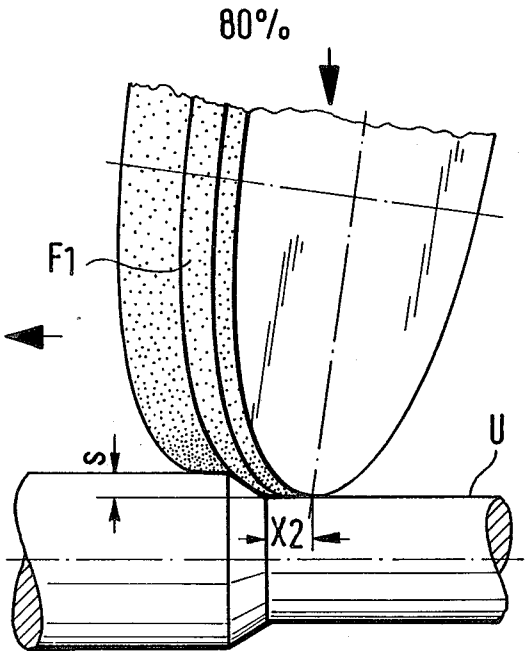
FIG. 4 is a view similar to FIG. 3, with a higher degree of wear of the grinding disk.
Figure 3:
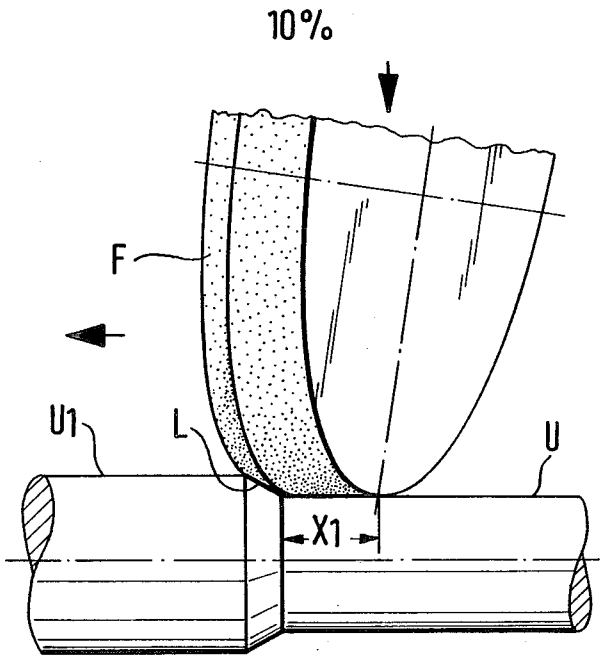
FIG. 3 is an enlarged partial view according to FIG. 1 showing a grinding disk which is up to 10% worn.

According to FIGS. 3 and 4, the grinding disk 2, which essentially has a flat surface, grinds the circumference of the workpiece at an angle whereby, corresponding to the grinding disk, a given portion of the circumference is to be ground off. At the beginning, an oblique surface F is formed, with which the grinding disk grinds a portion L which has to be removed from the workpiece, whereas because of the special arrangement of the grinding disk to the workpiece, there is present a clearly illustrated clearance angle between the straight surface line M of the grinding disk and the finished ground circumferential surface U of the workpiece 1, so that, when the grinding of the circumference U is finished, the circumference U can no longer come in contact with the grinding disk. While a considerable amount of the pressure of the grinding disk is here deflected in the direction of the axis via the portion L according to FIG. 3, the radially directed component of the grinding force acts only upon the point of the workpiece which is indicated by 1*a* in FIGS. 6 to 8. During the subsequent grinding, the frontal surface F moves in the direction opposite to the advancing direction of the grinding disk, towards the free edge of the disk, as illustrated in FIG. 4, in which the grinding disk is already worn down to 80% of thickness. In FIG. 4, the oblique frontal surface of the grinding disk is indicated by $F_1$.

Figure 8:
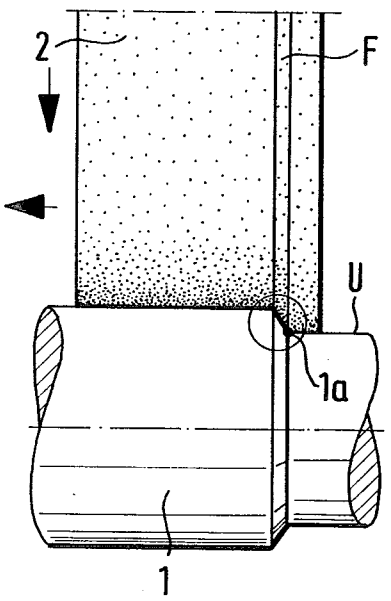
FIGS. 6 to 8 are various schematic views seen from the top, showing the kind of wear of the grinding disk.
Figure 7:
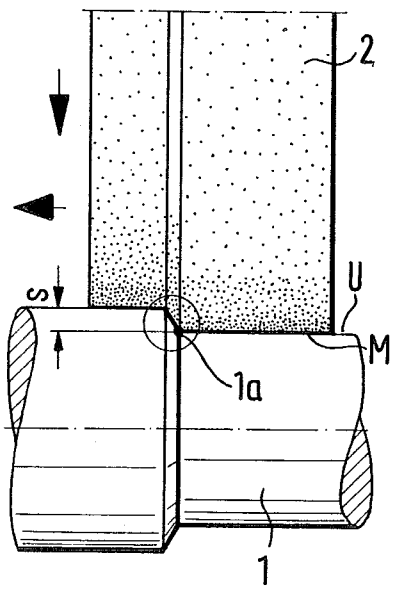
Figure 6:
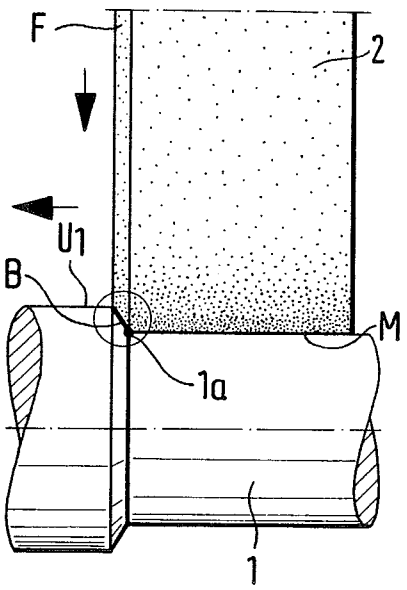

FIGS. 6 to 8 show schematically simplified illustrations of the wear of the grinding disk, in which the clearance angle formed between the straight surface line M of the grinding disk 2 and the circumferential line U of the already finished workpiece 1 is not illustrated. According to FIG. 6, the grinding disk 2 with its oblique frontal surface F acts against a portion B of the workpiece 1 corresponding to the desired grinding depth S. The arrows indicate the radial adjustment and the axial movement of the grinding disk 2 with respect to the workpiece 1. During the grinding process according to FIGS. 6 to 8, however, not only the diameter of the workpiece 1 is reduced at a grinding depth, but the grinding disk 2 also successively wears during the grinding process at a thickness corresponding to the grinding depth S. During the actual grinding, a considerable amount of the grinding pressure acts in axial direction, whereas the radial component of this pressure is transmitted by the grinding disk 2 to the workpiece 1 only at a point 1*a*. Thus, the grinding disk 2 makes point contact with the workpiece at the point 1*a*, so that the workpiece itself is not exposed to any considerable radial pressure. This point 1*a* lies perpendicular to the longitudinal axis of the workpiece at the location where the workpiece 1 receives its finishing grinding by the disk. In the shown exemplary embodiment, the finising grinding section is the circumferential line U of FIG. 7, whereas the circumferential section $U_1$ (FIG. 6) of the workpiece 1 still has to be ground down. Thus, the wear of the grinding disk occurs evenly in the form of a layer S corresponding to the grinding depth, so that as long as this layer has not been completely removed, the grinding disk also does not need to be readjusted or newly used. With reference to FIGS. 3 and 4, this means, therefore, that as long as a section $X_1$ and $X_2$ of the surface of the grinding disk is available for the grinding process, in contrast to the prior grinding process, it does not have to be constantly adjusted.

By means of the invention it is possible to perform very gentle high speed profile grinding of workpieces, because, in contrast to known methods of the circular grinding whereby up to over 90% of the forces act at a right angle to the axis of the workpiece, due to the point contact of the grinding disk 2 and workpiece 1 at the point 1*a*, the radial forces act only via this point. The main portion of the force is transmitted in the axial direction as a result of the oblique frontal surface.

Figure 10:
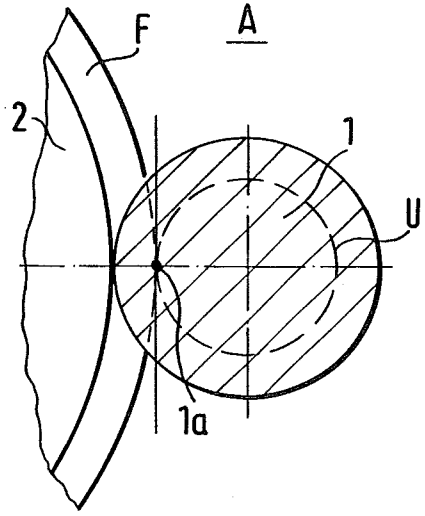
FIG. 10 is a front view of the workpiece and grinding disk according to arrow A of FIG. 9.
Figure 9:
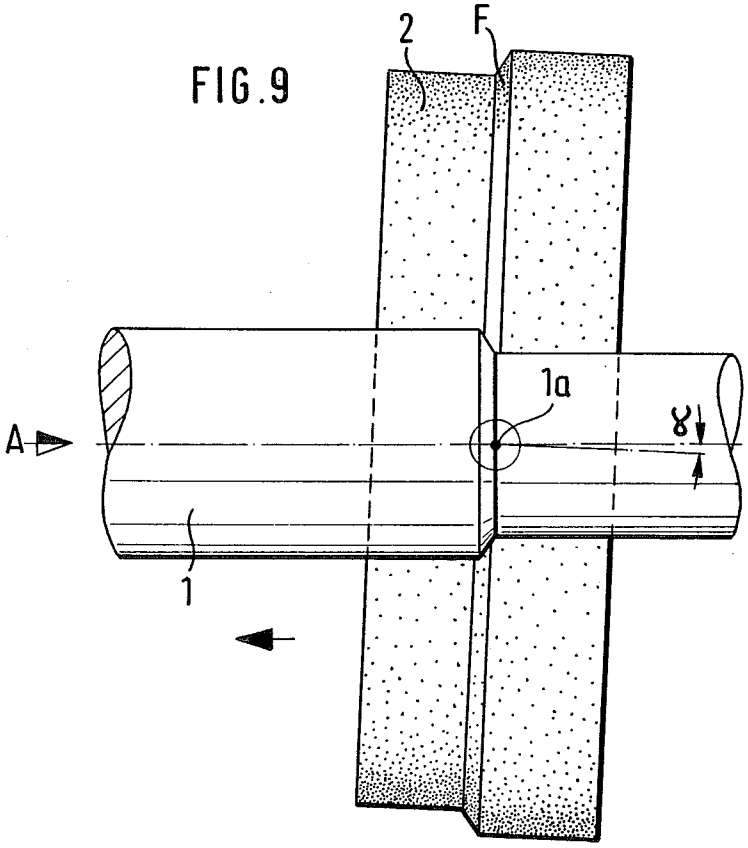
FIG. 9 is a partial view of the workpiece and grinding disk, wherein the clearance angle $\alpha$ between the oblique position of the grinding disk and the rotation symmetrical workpiece is shown.

In FIGS. 9 and 10, a simplified arrangement of a grinding disk with a workpiece is shown, wherein according to FIG. 9, the clearance angle $\alpha$ is indicated, so that the portion of the grinding disk, which lies on the workpiece 1, can no longer come into contact with the already ground surface. Here is also clearly shown how the grinding disk 2 evenly wears layerwise along its oblique frontal surface, when it is moved against the rotating workpiece in the direction of the arrow shown in FIG. 9.

In the drawing according to FIG. 10, it is clearly understood that the grinding disk 2 finishes working on the final diameter (circumferential line U), wherein it only acts on the workpiece via the point 1*a*, while the remaining grinding force at the oblique frontal surface F of the disk acts on the circumference of the workpiece which still has to be removed.

Figure 5:
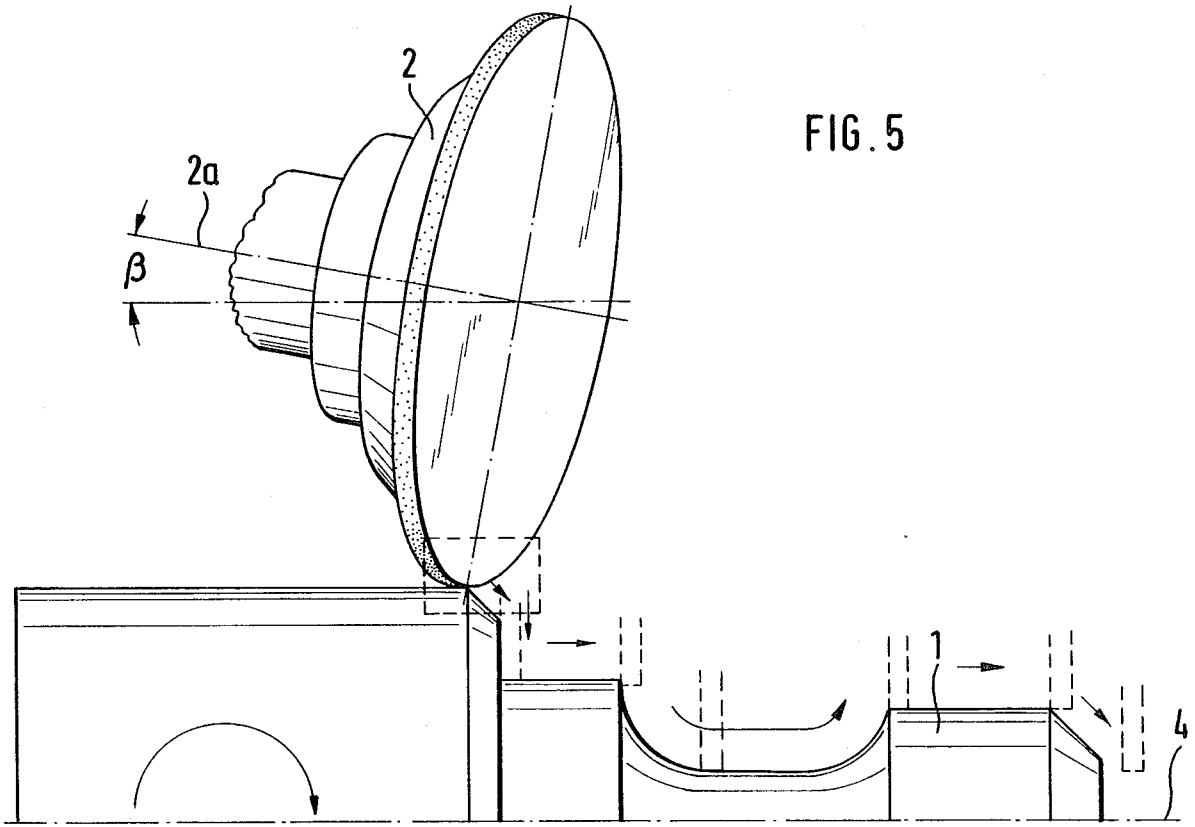
FIG. 5 is a schematic view of a grinding disk making contact with a rotation symmetrical workpiece.

FIG. 5 shows an embodiment of a profile grinding, wherein the skewed arrangement of the rotational axis 2*a* of the grinding body to the longitudinal axis 4 of the workpiece is illustrated. A programmable computer and numerically controlled grinding machine are here used, whereby the axial advancing of the grinding disk and its radial adjustment are also controlled by a computer program. Thus, it is made possible to provide a highly precise guidance of the grinding disk in accordance with the desired profile, so that it is possible in a technically inexpensive way to form on the circumference of the workpiece the profile given as an illustrative embodiment in FIG. 5.

The main attainable advantages can be summarized as follows:

(1) short grinding time (approximately 10–25%);

(2) low heat development;

(3) high rotational speed of workpiece;

(4) relatively narrow grinding disk.

In summary, the present invention provides, in a method and an apparatus for high speed profile grinding of rotatably clamped rotation symmetrical workpieces, a grinding disk with an essentially flat surface line which is guided against the surface of the workpiece so that during the grinding process, the grinding disk touches the circumference of the workpiece in the region of the finished outer surface, only at a point which lies perpendicular to the longitudinal axis of the workpiece, whereby the surface line of the grinding disk forms a clearance angle with respect to the circumferential line of the ground surface of the workpiece.

Thus, the invention contemplates a method for high speed profile grinding of rotation symmetrical workpieces which are clamped in a grinding machine for rotation around their longitudinal axis, in which a grinding disk is advanced along the rotational axis of the workpiece and is radially adjusted according to the circumferential profile to be ground, where the grinding disk grinding in front, having an essentially flat surface line, is guided against the surface of the workpiece to be worked so that the grinding disk touches the circumference of the workpiece during the grinding process in the region of its finished outer surface only at a point which lies perpendicular to the longitudinal axis of the workpiece, and the surface line of the grinding disk forms a clearance angle with respect to the circumferential line of the ground surface of the workpiece, so that the finished ground surface is no longer engaged with the grinding disk.

The apparatus as a grinding machine for the execution of the method entails a rotation symmetrical workpiece rotatably clamped at its two ends in a support and a grinding disk supported and driven by a grinding spindle, the grinding disk being advanceable along the rotational axis of the workpiece and being radially adjustable according to the desired profile of the grinding piece to be ground, in which the grinding disk 2 has an essentially flat surface line M, and the grinding disk 2 is arranged skewed in relation to the workpiece 1. Typically, the surface of the grinding disk M is cylindrical and the axis 2*a* of the grinding disk 2 forms an angle greater than zero with respect to the longitudinal axis 4 of the workpiece.

Generally, the axis of the grinding disk 2 having a conical surface and the axis of the workpiece 1 are arranged skewed relative to each other.

It thus will be seen that there is provided a method and apparatus for high speed profile grinding of rotatably clamped rotation symmetrical workpieces, which attains the various advantages of the invention and is well adapted for the conditions of practical use. As numerous alternatives within the scope of the present invention, besides those alternatives, equivalents, variations and modifications mentioned supra and shown in the drawings, will occur to those skilled in the art, it will be understood that the invention extends fully to all such equivalents and the like, and is to be limited only by the recitations in the appended claims, and functional and structural equivalents thereof.

What is claimed is:

1. A method for grinding of a rotation symmetrical workpiece, comprising:

clamping in a grinding machine a workpiece having a longitudinal axis and rotating the workpiece about the longitudinal axis thereof, providing a grinding disk having a central axis, a peripheral surface and a leading surface, said grinding disk having a hardness so that the grinding disk wears during grinding, installing the grinding disk adjacent the workpiece so that said peripheral surface is located radially inside and axially adjacent an imaginary cylindrical surface corresponding to the outer surface of the workpiece to be ground, said peripheral surface being arranged relative to the axis of the workpiece to form a clearance angle between said peripheral surface and the surface of the workpiece that is ground, and rotating the grinding disk about the central axis thereof and moving the grinding disk in a direction parallel to the longitudinal direction of the workpiece so that said leading surface engages the workpiece and grinds the workpiece while the grinding disk wears, whereby said leading surface makes contact with the workpiece during grinding and the grinding disk makes only point contact with the workpiece after grinding, independently of the wear of the grinding disk.

2. A method according to claim 1, in which the intersection of an axial cross-section of said grinding disk and said peripheral surface is a straight line.

3. A method according to claim 1, in which said peripheral surface is frustoconical.

4. A method according to claim 1, in which said peripheral surface is cylindrical.

5. A method according to claim 1, in which the clearance angle is so small that, independently of wear of the leading surface, the point of contact remains at a point defined by the intersection of the leading surface, the peripheral surface and the workpiece.

6. A method according to claim 1, in which said workpiece axis and said grinding disk axis are oblique relative to each other.

7. A method according to claim 1, in which said workpiece axis and said grinding disk axis are skewed relative to each other.

8. A method according to claim 6, in which said peripheral surface is frustoconical.

9. A method according to claim 7, in which said peripheral surface is frustoconical.

10. Apparatus for grinding of a rotation symmetrical workpiece, comprising a grinding machine;

means for clamping the workpiece in the grinding machine along a longitudinal axis of the workpiece;

a grinding disk having a peripheral surface and a leading surface;

means for moving the grinding disk in a direction parallel to the longitudinal direction of the workpiece and radially setting the grinding disk in correspondence with a circumferential profile of the workpiece to be ground; and means for mounting the grinding disk with said peripheral surface arranged with respect to the axis of the workpiece to form a clearance angle between said peripheral surface and the surface of the workpiece that is ground, whereby said leading surface makes contact with the workpiece during grinding and the grinding disk makes only point contact with the workpiece after grinding independently of wear of the grinding disk.

11. Apparatus according to claim 10, in which the intersection of an axial cross-section of said grinding disk and said peripheral surface is a straight line.

12. Apparatus according to claim 10, in which said peripheral surface is frustoconical.

13. Apparatus according to claim 10, in which said peripheral surface is cylindrical.

14. Apparatus according to claim 10, further comprising means for relatively orienting the axis of the grinding disk and said workpiece axis in oblique relationship.

15. Apparatus according to claim 14, in which the orienting means is adjustable.

16. Apparatus according to claim 14, in which said peripheral surface is frustoconical.

17. Apparatus according to claim 10, further comprising means for relatively orienting the axis of the grinding disk and said workpiece axis in skewed relationship.

18. Apparatus according to claim 17, in which the orienting means is adjustable.

19. Apparatus according to claim 17, in which said peripheral surface is frustoconical.

* * * * *